United States Patent [19]

Pfeiffer

[11] Patent Number: 4,938,326

[45] Date of Patent: Jul. 3, 1990

[54] CARRYING CASE HAVING A LID WITH A COMPARTMENT MOUNTED ON THE SURFACE OF THE LID

[75] Inventor: Michael Pfeiffer, Ismaning Munich, Fed. Rep. of Germany

[73] Assignee: MP Lizenzen- und Reisegepaeck Vertriebs GmbH, Munich, Fed. Rep. of Germany

[21] Appl. No.: 325,640

[22] Filed: Mar. 20, 1989

[30] Foreign Application Priority Data

Mar. 28, 1988 [DE] Fed. Rep. of Germany ... 8804178[U]

[51] Int. Cl.[5] ..... A45C 3/02; A45C 5/04; A45C 15/00; A45C 13/28

[52] U.S. Cl. ..... 190/109; 190/111; 190/112; 190/118; 150/104; 150/117; 383/907

[58] Field of Search ..... 190/100, 102, 109, 110, 190/112, 122, 111; D3/71, 48, 74; 150/101, 104, 117, 113; 383/907

[56] References Cited

U.S. PATENT DOCUMENTS

| | | | |
|---|---|---|---|
| D. 182,868 | 5/1958 | Arnold | D3/71 X |
| 2,429,856 | 10/1947 | Vasquez | 150/117 |
| 2,851,076 | 9/1958 | Stakofsky | 150/117 X |
| 3,388,777 | 6/1968 | Nolan | 190/109 |
| 3,410,376 | 11/1968 | Benzel | 190/110 |
| 4,022,261 | 5/1977 | Russell | 150/101 X |
| 4,270,590 | 6/1981 | Marshall | 190/100 |
| 4,693,346 | 9/1987 | Eversdijk | 190/112 X |
| 4,729,460 | 3/1988 | Kim | 190/109 |

FOREIGN PATENT DOCUMENTS

| | | | |
|---|---|---|---|
| 192124 | 12/1907 | Fed. Rep. of Germany | 190/100 |
| 2914620 | 10/1980 | Fed. Rep. of Germany | 190/102 |
| 1132752 | 3/1957 | France | 150/117 |
| 2455442 | 1/1981 | France | 190/122 |

*Primary Examiner*—Sue A. Weaver

*Attorney, Agent, or Firm*—Jordan and Hamburg

[57] ABSTRACT

A carrying case comprises an octagonal shaped body fitted with an octagonal shaped lid, a trapezoidal shaped compartment being located on an octagonal shaped surface of the octagonal shaped lid. The compartment is fitted with a trapezoidal shaped lid. The entire perimeter of the trapezoidal shaped lid is defined by four slanting surfaces each which forms an obtuse angle with the octagonal shaped surface of the octagonal shaped lid. Each of the slanting surfaces has an outer edge parallel to an edge of the octagonal shaped surface of the lid. The body includes a wall perpendicular to the octagonal shaped surface and on which is mounted a carrying handle for the carrying case. The carrying handle is substantially L-shaped and has a shorter leg oriented perpendicualar to and fixed to the aforementioned wall and a longer leg spaced from and oriented parallel to the aforementioned wall and has its major dimension in a plane parallel to the plane of the octagonal shaped surface. In the shorter leg is mounted a lock for the case. The trapezoidal shaped lid has a trapezoidal shaped surface adapted to receive interchangeably variously imprinted panels.

2 Claims, 1 Drawing Sheet

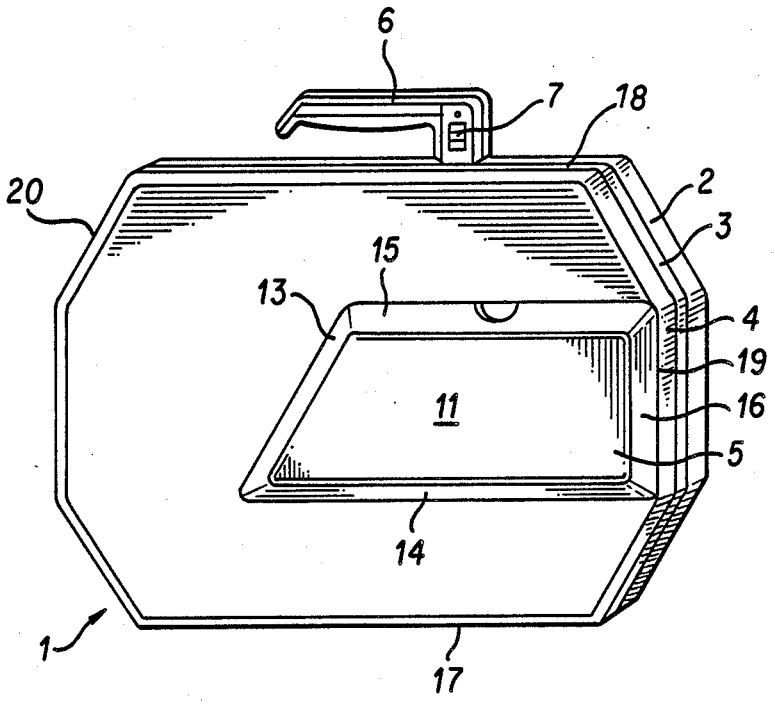
6
7
18
20
2
3
15
13
4
19
11
16
5
14
1
17

CARRYING CASE HAVING A LID WITH A COMPARTMENT MOUNTED ON THE SURFACE OF THE LID

The invention relates to a portable container in the form of a carrying case, comprising at least one bottom section and one lid as well as a handle.

Carrying cases of this type are widely known.

It is the aim of the invention to provide a container of the aforementioned type in line with present day fashion trends, which container does not only differ visually from known carrying cases but is of such construction that, for example, advertising imprints can be mounted therein in such a manner as to be interchangeable without being scraped off the container, which might damage the container.

This aim is achieved according to the invention by accommodating at the front surface of the container's lid a contoured surface-mounted compartment which covers an area smaller than that of the lid, and which has slanting surfaces set at an obtuse angle to the front area of the lid.

Suitable further developments of the portable container according to the invention are contained in the subclaims.

The main advantage of the design of a portable container according to the invention is that it is not technically complicated and that it is of sturdy construction. As the lid of the surface-mounted compartment is exchangeable, it can be used to carry varying advertising imprints. In a preferred model of the invention, the outer shape of the surface-mounted compartment is trapezoidal, but it can also be a rectangle or a parallelogram. If required, the surface-mounted compartment can also be used as a receptacle of various utensils, in which case the lid of the compartment can be hinged to the bottom of the surface-mounted compartment. The container comprises a handle with integrated toothed lock, which prevents access to its contents by unauthorised persons.

Further advantages are given in the following descriptions of a specific embodiment of the invention as illustrated in the drawing, which is a front perspective view of a carrying case according to the invention.

In the drawing is illustrated a portable container in the form of a carrying case 1 of octagonal configuration and having a bottom section 2 extending as one piece into a central section 3 which has attached to it a handle 6 including a locking device, the latter in the illustrated example toothed lock 7, and, further provided with a lid 4. The front surface of the lid 4 has attached to it a raised, shaped surface-mounted compartment 11 having a lid 5. In front view, the surface-mounted compartment is trapezoidal, but it can also be shaped as a rectangle or a parallelogram. The lid 5 includes a front surface parallel with the front surface of the lid 4 and which at its edges is contiguous with slanting surfaces 13, 14, 15, 16. The outside edges of the slanting surfaces 13, 14, 15, 16 correspond precisely the perimeter of the bottom of the surface-mounted compartment.

As shown in the drawing, the outside edges of the slanting surfaces of the surface-mounted compartment 11 each run parallel to a corresponding side edge of the lid 4. Specifically, the outside edges of the slanting surfaces 14, 15 run parallel to the lower and upper edges 17, 18, respectively, of the lid 4, the outside edge of the slanting surface 16 corresponds to the right side edge 19 of the lid 4, and the slanting surface 13, which connects the slanting surfaces 14, 15 so as to form a trapezoidal shape, has an outside edge which runs parallel to edge 20 of the lid 4.

The lid 5 of the surface-mounted compartment 11 serves to interchangeably receive panels bearing advertising slogans and the like.

As can be seen in the drawing not only the lid 4 but the entire carrying case 1 is octagonally shaped.

Suitable variations of the described model can be made without deviating from the essence of the invention.

I claim:

1. A carrying case comprising an octagonal shaped body fitted with an octagonal shaped lid, a trapezoidal shaped compartment located on an octagonal shaped surface of the octagonal shaped lid, the compartment being fitted with a trapezoidal shaped lid, the entire perimeter of the trapezoidal shaped lid being defined by four slanting surfaces each which forms an obtuse angle with the octagonal shaped surface of the octagonal shaped lid, each of the slanting surfaces having an outer edge parallel to an edge of the octagonal shaped surface of the lid, the body including a wall perpendicular to said octagonal shaped surface and on which is mounted a carrying handle for the carrying case, the carrying handle being substantially L-shaped and having a shorter leg oriented perpendicular to and fixed to said wall and a longer leg spaced from and oriented parallel to said wall and having its major dimensions in a plane parallel to the plane of said octagonal shaped surface, and a lock for said case mounted in said shorter leg.

2. A carrying case according to claim 1, in which the trapezoidal shaped lid has a trapezoidal shaped surface adapted to receive interchangeably variously imprinted panels.

* * * * *